United States Patent [19]

Lautenschläger

[11] Patent Number: 4,976,006

[45] Date of Patent: Dec. 11, 1990

[54] FURNITURE HINGE

[75] Inventor: Karl Lautenschläger, Reinheim, Fed. Rep. of Germany

[73] Assignee: Karl Lautenschlager GmbH & Co. KG., Reinheim, Fed. Rep. of Germany

[21] Appl. No.: 365,969

[22] Filed: Jun. 14, 1989

[30] Foreign Application Priority Data

Jun. 15, 1988 [DE] Fed. Rep. of Germany ..... 3820338

[51] Int. Cl.[5] ..... E05D 7/04; E05D 7/12

[52] U.S. Cl. ..... 16/238; 16/240; 16/246; 16/257; 16/260; 16/370; 16/382; 16/DIG. 43

[58] Field of Search ..... 16/236, 237, 238, 240, 16/241, 246, 251, 254, 257, 269, 370, 382, DIG. 43; 403/327, 330

[56] References Cited

U.S. PATENT DOCUMENTS

| | | | |
|---|---|---|---|
| 4,703,539 | 11/1987 | Lautenschlager | 16/382 |
| 4,760,623 | 8/1988 | Toyama | 16/382 |
| 4,799,289 | 1/1989 | Grass | 16/382 |
| 4,800,622 | 1/1989 | Röck et al. | 16/382 |
| 4,823,436 | 4/1989 | Salvi | 16/258 |
| 4,839,940 | 6/1989 | Grass | 16/382 |
| 4,841,598 | 6/1989 | Grass | 16/251 |
| 4,847,948 | 7/1989 | Grass et al. | 16/382 |
| 4,881,297 | 11/1989 | Grass | 16/382 |
| 4,882,808 | 11/1989 | Rock et al. | 16/DIG. 43 |
| 4,888,853 | 12/1989 | Rock et al. | 16/382 |

FOREIGN PATENT DOCUMENTS 3119571 12/1982 Fed. Rep. of Germany .

3525279 1/1987 Fed. Rep. of Germany .

*Primary Examiner*—Richard K. Seidel
*Assistant Examiner*—Edward A. Brown

[57] ABSTRACT

Furniture hinge whose cabinet-related part is configured as a supporting arm of channel-shaped cross section astride the corresponding mounting plate, the mounting plate being composed of two separable members which are adjustable relative to one another. The bottom mounting plate member can be fastened to the cabinet and the upper plate is releasably joined to the supporting arm by a catch mechanism. The catch mechanism has projections extending from its opposite lateral surfaces in the door end of the upper mounting plate member while at the inner end of the supporting arm more remote from the door at least one resilient tongue having a catch section is formed, which engages a catch recess on the inner end of the upper mounting plate member. The supporting arm straddles the upper mounting plate member at least at its end pointing into the cabinet interior, and is provided in the straddling area with two tongues which are resiliently flexible parallel to the supporting wall surface. Each tongue has a catch section which is matingly engaged with an associated catch recess in the upper mounting plate member. The catch sections and the catch recesses can be brought out of engagement by squeezing the tongues together. Each tongue has a handle which is accessible when the supporting arm is mounted on the upper mounting plate member, for the purpose of squeezing the tongues together parallel to the supporting wall surface.

14 Claims, 4 Drawing Sheets

Fig. 1
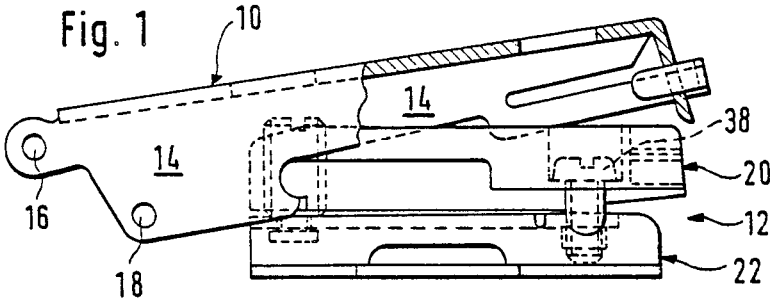
Fig. 2
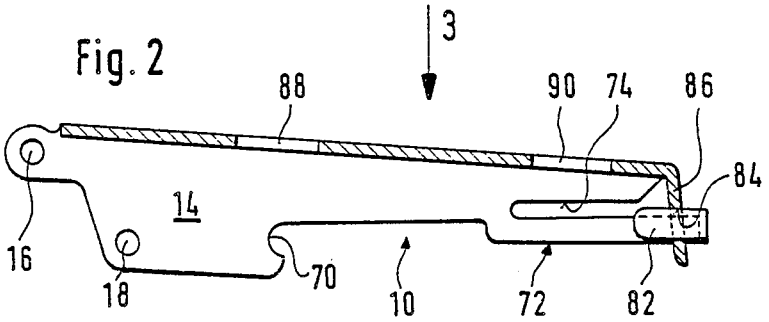
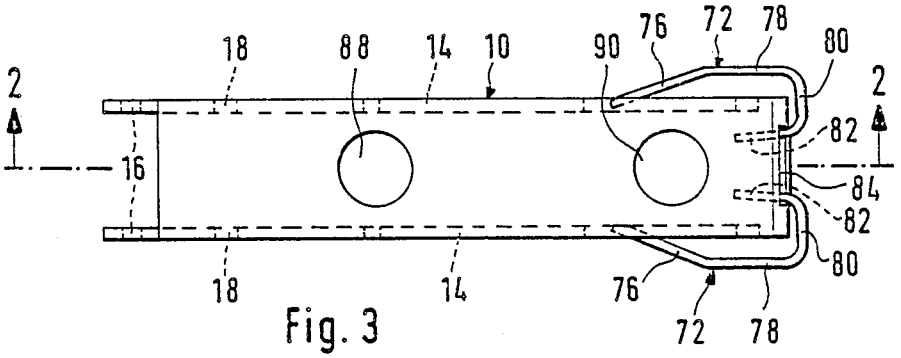
Fig. 3

Fig. 8
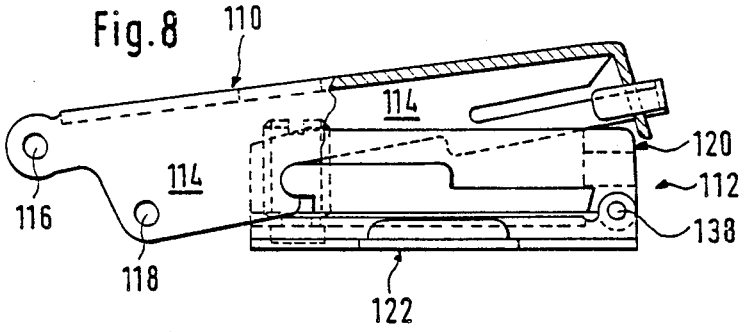
Fig. 9
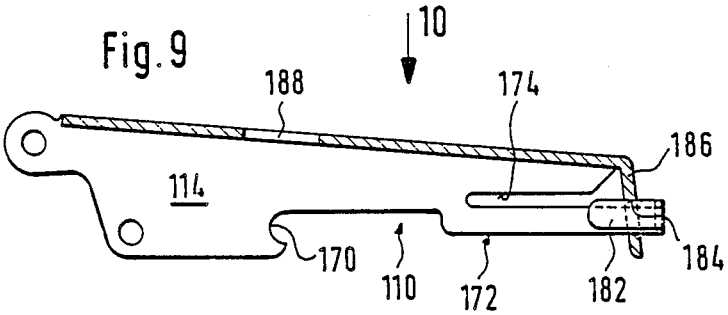
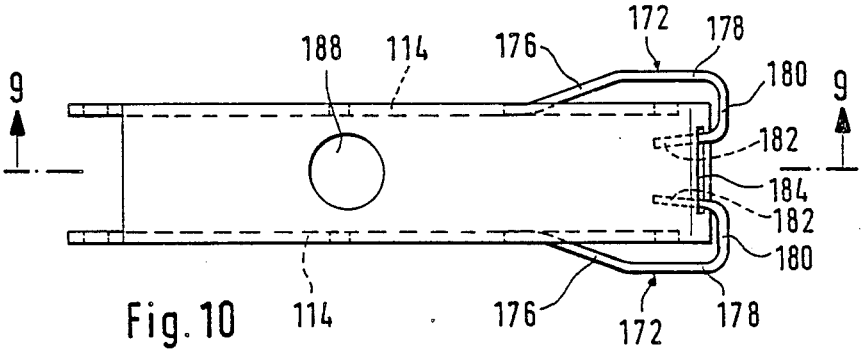
Fig. 10

FURNITURE HINGE

BACKGROUND OF THE INVENTION

The invention relates to a hinge for hanging a door on the carcase of a piece of furniture, with a door-related hinge part which can be fastened to the door and a carcase-related hinge part. The carcase-related hinge part can be placed removably on a mounting plate affixed to the wall of the carcase, is coupled to the door-related part by a linking mechanism, and is configured as a supporting arm with an inverted U-shaped cross section straddling the mounting plate. The mounting plate is composed of two separable members which can be adjusted relative to one another; the bottom member nearer the cabinet wall can be affixed to the cabinet wall, and the upper part more remote from the cabinet wall is joined releasably to the supporting arm by a catch mechanism. The catch mechanism has, in the front end area of the upper mounting plate member nearer the door leaf, projections extending from its confronting lateral surfaces; these projections are associated with slots opening in the bottom margin of the lateral flanges of the supporting arm and permitting the introduction of the projections, while at the inner end of the supporting arm remote from the door leaf at least one resilient tongue with a detent section is formed, which in the proper connecting position is engaged in a catch recess at the inner end of the upper mounting plate member.

In the hinges constructed in this manner (DE-OS 31 19 571; FIGS. 3 to 7) it is possible to release successively from the wall the supporting arms of the hinge whose other part is mounted on a door or to fasten them thereon, without the need for difficult manipulations, by releasing the catch mechanism and raising the hinge supporting arm. This is advantageous especially in the case of tall cabinets on which the doors are mounted with more than two hinges, because the doors can then be dismounted and reinstalled even by unassisted persons.

The catch mechanism of the known hinge is formed by a bent end section of the cabinet-interior web of the [channel-shaped] supporting arm which can be snapped over a transverse edge formed on the upper mounting plate member. This catch connection alone, however, is not sufficiently secure against unsnapping to hold the supporting arm by itself, i.e., without additional securing. Consequently, an additional mounting screw which can be driven into a tap in the upper mounting plate member is provided, whose threaded shank passes through a slot in the free transverse edge of the bent end section of the web, and whose head, when tightened down, holds the bent end section of the web on the upper mounting plate member. Therefore, before the supporting arm is unsnapped, first the mounting screw has to be backed out of the tap in the upper mounting plate member sufficiently to permit the supporting arm to be released. This loosening of the mounting screw upon disassembly and turning it back in after assembly is obviously time-consuming and laborious and thus is an obstacle to the quick and simple mounting of the supporting arm on the mounting plate and its removal therefrom. Therefore methods have already been developed for a simpler and quicker mounting and dismounting of hinges at their cabinet-related end, in which the catch mechanism is provided not between the supporting arm and the mounting plate but between the upper and lower mounting plate members, so that a supporting arm once fastened in the conventional manner on the mounting plate can be dismounted by unsnapping the upper mounting plate member, which remains on the supporting arm, from the lower mounting plate member, and by snapping the upper mounting plate member back onto the bottom mounting plate member. The snap mechanism of a known (DE-OS 35 25 279) mounting plate that is constructed in this manner is formed by a slide which is guided in the bottom mounting plate member and biased to the catching position by a spring, and which has a catch projection having a ramp surface. The catch surface in the upper mounting plate, which has a ramp surface of complementary inclination, is held resiliently in engagement in the upper mounting plate member. The slide is operated by means of a handle disposed on the rearward prolongation of the slide pointing into the cabinet interior. The catch mechanism has proven practical, yet it is of a relatively complex construction and is accordingly expensive. The handle provided on the carcase-interior end of the mounting plate is operated by exerting an unlocking movement on the handle outwardly from the case interior. Now, it is not entirely impossible that, in the case of a very fully packed cabinet, the handle may be accidently shifted in the unlocking direction when the door is closed, if, for example, it comes in contact with a protruding coat hanger or other projecting object, before the door is entirely closed. In the worst case this might then result in an unsnapping of the upper mounting plate member from the bottom mounting plate member and thus of the hinge held on this mounting plate, which in the case of doors hung with only two hinges on the cabinet makes it not unlikely that they might fall off.

It is the purpose of the invention to create an effective catch mechanism between the hinge's supporting arm and the upper mounting plate member of the bipartite mounting plate, which will substantially improve the simplicity of the catch mechanisms of hinges provided on the carcase side and at the same time securing it against unintentional release.

SUMMARY OF THE INVENTION

Setting out from a hinge of the kind described above, this purpose is accomplished in accordance with the invention by the fact that the supporting arm partially straddles the upper mounting plate member at least at its end area pointing into the carcase interior, and is provided in the straddling area with two tongues which can be flexed resiliently parallel to the supporting wall surface, each having a catch section, each catch section being held in form lock by an associated catch recess in the upper mounting plate member, the catch sections and catch recesses being able, however, to be disengaged by flexing the tongues against one another parallel to the supporting wall surface, and that each tongue has a handle which is accessible for pressing them against one another parallel to the supporting wall surface. The simplification of the construction of the catch mechanism is thus accomplished by placing the catch sections on the resilient tongues, so that a precisely made separate actuating slide to be disposed in a fitting in one of the parts to be engaged is unnecessary. Since two tongues are provided, and thus before the supporting arms can be separated from the upper mounting plate, both catch sections have to be forced out of the corresponding catch recesses in the upper mounting plate member, and since it is necessary that both tongues be squeezed together parallel to the supporting wall surface for this purpose, it is impossible for the parts to be released accidentally. Therefore a separate screw for mounting the supporting arm to secure the engagement is not necessary. Even if, when the door is closed, one of the handles formed on the tongues collides with an object which exerts an unlocking pressure on the tongue as closing of the door continues, only one of the catch sections will be displaced to the release position, while the second catch section will continue to secure the supporting arm reliably against separation from the mounting plate. The arrangement of the tongues and thus of the handles on the supporting arm has the result that these handles can be used not only to release the supporting arm but also for lifting up the supporting arm after its release.

In a preferred embodiment of the invention the resilient tongues are integral strip-like sections cut from the material of the lateral flanges of the supporting arm, the tongues being preferably formed by cuts in the lateral flanges, starting from the cabinet-interior end.

The catch recesses provided in the upper mounting plate member preferably have insertion openings on the top side pointing toward the supporting arm for the catch sections provided on the resilient tongues, the insertion openings and/or the catch sections being provided with at least one ramp surface resiliently deflecting the associated catch section in the release direction upon insertion, and then being provided in the insertion direction each with an undercut surface under which the catch sections together snap when the proper catching position of the supporting arm and upper mounting plate member is reached.

The resilient tongues can be divided at a point following the area of transition to the associated lateral flanges of the supporting arm into a plurality of tongue sections running at an angle to one another, the first of which is bent outwardly in the direction of the cabinet-interior end of the supporting arm, the adjoining tongue section forming the handle is bent back to a position approximately parallel to the longitudinal central axis of the supporting arm, and the next-following tongue section being bent at approximately right angles to the longitudinal central axis, and the adjoining end section, forming the actual catch section, being bent again to a position approximately parallel to the longitudinal central axis.

Preferably, the tongue sections forming the catch section are bent from the tongue sections bent at right angles to the longitudinal central axis toward the cabinet-interior end of the supporting arm.

To make the locking engagement of the tongue catch sections with the catch recesses of the upper mounting plate member in the direction of disassembly, i.e., at right angles to the supporting wall surface, as stiff as possible, provision is made in an advantageous further development of the invention so that the resilient tongues will be guided in the vicinity of the catch section by a window-like opening in a wall of the supporting arm overreaching the cabinet-interior end wall of the upper mounting plate member, whose clear height measured at right angles to the supporting wall surface is approximately equal to or only slightly greater than the height of the tongue in the area where it passes through the opening, while its clear width measured in the direction in which the tongue is actuated upon release will depend only on the amount the tongue has to be bent in order to release. By the guidance of the tongues in the window-like opening deformation of the tongue relative to the supporting arm at right angles to the supporting wall surface is prevented, while on the other hand the flexing parallel to the supporting wall surfaces required for release will be possible within the width of the window-like opening.

In an advantageous further development of the invention the mounting plate can be so configured that the upper mounting plate member, in its rearward, cabinet-interior end portion, is mounted so as to be able to pivot on the bottom mounting plate member parallel to the supporting wall surface and at right angles to the length of the supporting arm, that in the front end portion of the upper mounting plate member a threaded spindle is threaded into a tap running approximately at right angles to the supporting wall surface while its end facing the supporting wall has a holding head attached through a neck of reduced diameter to the threaded spindle, and that the neck is held in the lower mounting plate member in a longitudinally disposed slot open at the cabinet-exterior end. The possibility thus created for varying the overlap or coverage of a door with respect to the front edge of the cabinet wall by turning the upper mounting plate member relative to the lower mounting plate member has the advantage that the threaded spindle provided for the turning adjustment is driven not, as otherwise customary, into a tap in the hinge supporting arm but into a tap in the upper mounting plate member that is covered by the supporting arm. The appearance of the hinge supporting arm therefore is not impaired by the protruding section of the threaded spindle, and the threaded spindle cannot cause damage to articles of clothing on which it catches.

At the same time the mounting plate can be configured as a so-called "wing plate" if the bottom mounting plate member has a wing-like projection extending from each of the opposite longitudinal sides of the mounting plate member, and a mounting hole is provided in each of the projections. These mounting holes in the wing-like projections can then best be in the form of slots running parallel to the length of the supporting arm, which permit the position in which the mounting plate is fastened to be changed with respect to its distance from the edge of the supporting wall and thus permit an adjustment of the gap between the inside surface of the closed door and the edge of the supporting wall.

The axis of rotation permitting the turning of the upper mounting plate member relative to the lower one is, in a preferred embodiment of the invention, formed by a projection running transversely of the length of the supporting arm and extending from one mounting plate member to the other mounting plate member, which is mounted in at least one recess disposed in the same direction in the other mounting plate member, the upper mounting plate member containing a through-opening intersecting the pivot axis at right angles through which the threaded shaft of a mounting screw can be driven into a tap in the bottom mounting plate member. This mounting screw thus prevents the escape of the transversely disposed projection from the associated recess.

If the bottom mounting plate member is stamped from sheet metal, the tap for the mounting screw is best provided in a resiliently flexible lug cut from the material of the bottom mounting plate member, and this lug compensates for changes in the angular position of the upper mounting plate member relative to the bottom mounting plate member by resilient flexure. That is to say, it is not necessary to loosen this mounting screw in the event of a rotation of the two mounting plate members relative to one another.

To permit an additional, third adjustment, namely the vertical adjustment of a door hung with the hinge, the configuration can also be made such that the transversely running projection protrudes from the two opposite sides of the associated mounting plate member, the through-opening being in the form of a slot running transversely of the supporting arm length, and furthermore the longitudinal slot in the bottom mounting plate member merges in the areas through which the neck of the threaded spindle passes with an elongated slot section also running transversely of the supporting arm length, whose width is approximately equal to or only slightly greater than the diameter of the neck. Within the length of the slot or of the transversely running section of the slot, it is then possible to vary the relative vertical position, i.e., parallel to the hinge turning axis, in which the upper mounting plate member is fastened on the bottom mounting plate member, i.e., parallel to the hinge's turning axis.

In an alternative configuration of the mounting plate, in which the upper mounting plate is not vertically adjustable relative to the bottom mounting plate, the configuration can also be made such that one of the two mounting plate members clutches around the sides of the other in the area of the axis of rotation permitting their relative turning, and that aligned pivot holes are provided in the clutching areas of the mounting plate members through which a pivot pin passes.

BRIEF DESCRIPTION OF THE DRAWINGS

The invention will be further explained in the following description of two embodiments in conjunction with the drawing wherein:

FIG. 1 is a partially cut-away side view of the supporting arm and mounting plate of a first embodiment of the hinge in accordance with the invention, in which the supporting arm is shown released from the mounting plate and in the raised position at its rearward end.

FIG. 2 is a longitudinal central section through the supporting arm of the embodiment shown in FIG. 1, as seen in the direction of arrows 2—2 in FIG. 3;

FIG. 3 is a plan view of the supporting arm, as seen in the direction of arrow 3 in FIG. 2;

FIG. 8 is again a cut-away side view of the supporting arm and mounting plate of a second embodiment of the hinge of the invention, in which the supporting arm is shown released from the mounting plate and raised up at its inner end;

FIG. 9 is a longitudinal central section through the supporting arm of the embodiment in FIG. 8, seen in the direction of arrows 9—9 in FIG. 10;

FIG. 10 is a top view of the supporting arm seen in the direction of arrow 10 in FIG. 9;

DESCRIPTION OF PREFERRED EMBODIMENTS

Figure 4:
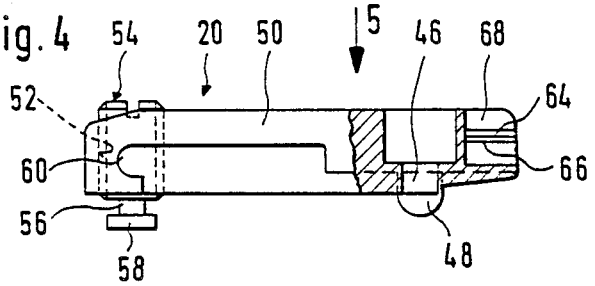
FIG. 4 is a side view, partially cut away at the rearward end, of the upper member of the mounting plate of the embodiment of FIG. 1.
Figure 5:
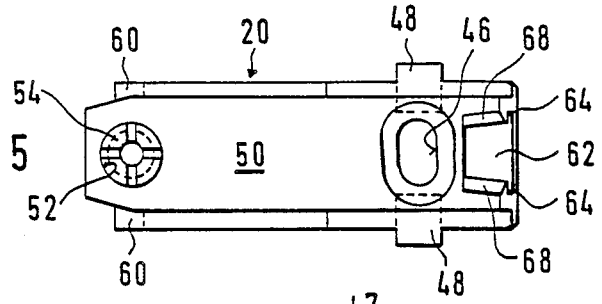
FIG. 5 is a top view of the upper member of the mounting plate seen in the direction of arrow 5 in FIG. 4.
Figure 6:
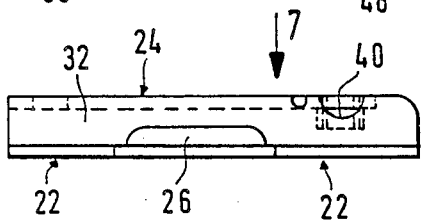
FIG. 6 is a side view of the bottom member of the mounting plate of the embodiment in FIG. 1.
Figure 7:
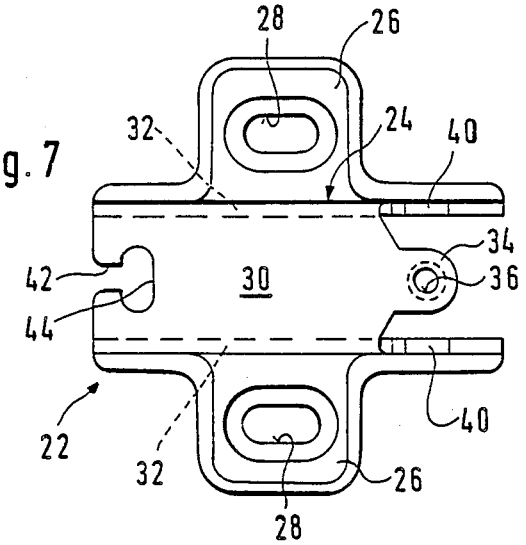
FIG. 7 is a top view of the bottom member of the mounting plate seen in the direction of arrow 7 in FIG. 6.
Figure 11:
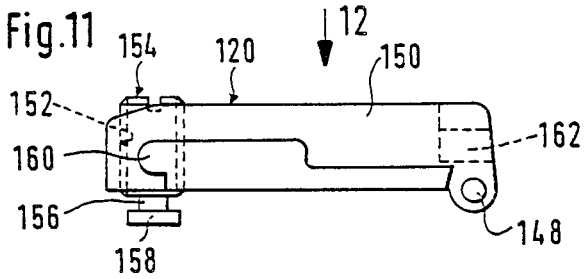
FIG. 11 is a side view of the upper member of the mounting plate of the embodiment of FIG. 8.
Figure 12:
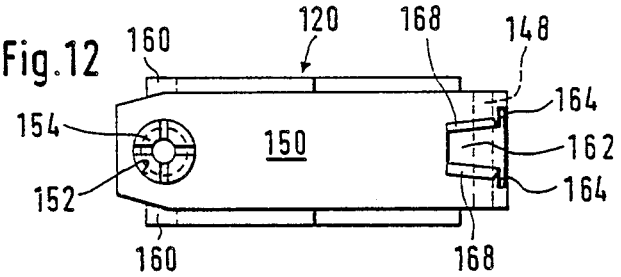
FIG. 12 is a top view of the upper mounting plate member, seen in the direction of arrow 12 in FIG. 11.
Figure 13:
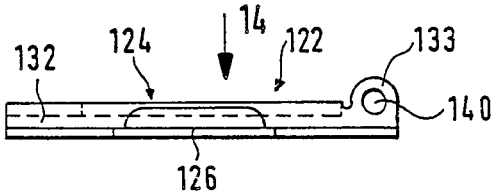
FIG. 13 is a side view of the lower member of the mounting plate of the embodiment in FIG. 8.
Figure 14:
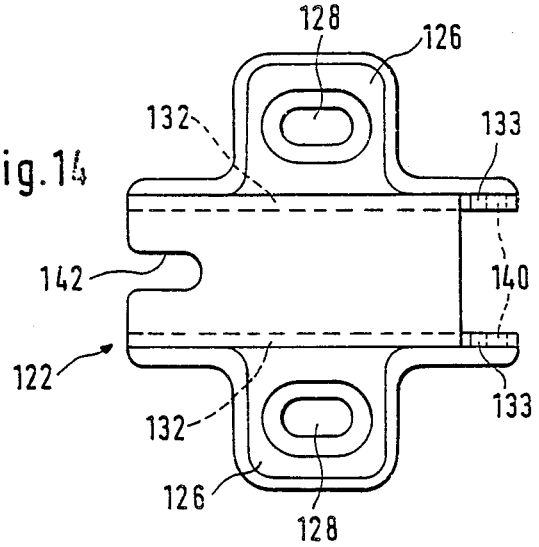
FIG. 14 is a top view of the lower mounting plate member, seen in the direction of arrow 14 in FIG. 13.

In FIG. 1 are shown the supporting-wall part of a cabinet hinge, namely the elongated supporting arm 10 shown separately in FIGS. 2 and 3, with the conventional channel-shaped cross section and the mounting plate 12 which is to be fastened on the supporting wall (not shown) of a cabinet and on which the supporting arm can be mounted and dismounted simply and quickly in the manner to be described below. The supporting arm 10 has, in its lateral flanges 14 in its front end portion pointing out of the interior of the cabinet on which it is to be fastened, two pivot holes 16 and 18 in which the ends of pivot pins, not shown, are riveted, which form the supporting wall end pivots for two hinge links whose other ends are journaled in the corresponding door-related hinge part, which is to be reckoned as a conventional cup fastened in a mortise in the door. The supporting arm 10, which is shown by way of example, is thus part of a conventional four-pivot hinge, the rest of which is not shown, but it is to be noted that the configuration of the supporting arm and mounting plate provided in the scope of the invention is not limited to four-pivot hinges but can also be used in hinges with linking mechanisms differently configured. The mounting plate 12 in turn is composed of two members 20, 22, of which the upper member 20 (FIGS. 4 and 5) holding the supporting arm 10 is held adjustably on the bottom member 22 (FIGS. 6 and 7) which is to be fastened to the cabinet wall.

In the illustrated case, the mounting plate 12 is configured as a so-called wing plate, in which the bottom member 22, which is to be fastened on the cabinet wall and, in the present case, is stamped from sheet metal, has an elongated, flat central mounting section 24 with wing-like projections 26 extending one from each of the two opposite longitudinal sides, in each of which an opening in the form of a slot 28 is provided for mounting. The slots 28 in the illustrated embodiment are parallel to the length of the mounting section 24 in order to permit the bottom mounting plate member to be fastened for adjustment in the horizontal direction on the wall of a corresponding cabinet by means of screws (not shown) driven into the wall through the slots 28. That is to say, the orientation of the slots 28 permits the adjustment of the gap between the inner surface of a door mounted with the hinge of the invention on a cabinet, and the corresponding front edges of the cabinet, if it is assumed that the door is a so-called "overlay" door. If this adjustment is not necessary or is made elsewhere, the orientation of the slots can also be turned 90°, i.e., transversely of the mounting section 24 or parallel to the axis of rotation of the hinge, thus permitting adjustment of the height of the hinge. The flat, upper central surface 30 of the mounting section 24 is shorter than the lateral walls 32 at the rearward end, i.e., the cabinet-interior end, where it bears a lug 34 in which a tap 36 is provided for the threaded shaft of a screw 38 (FIG. 1) which holds the upper mounting plate member 20 on the bottom member 22 at its cabinet-interior end. In alignment with the central axis transversely intersecting the tap 36, open-topped circularly rounded notches 40 are provided in the side walls 32 of the mounting section 24. In the forward end of the central area 30, however, an open-end slot 42 is created in the center of the front end of the central surface 30 and merges with a slot 44 running at right angles to slot 42 at a distance from the front edge of the central area.

The upper mounting plate member 20 is provided with a countersunk slot 46 running transversely in alignment with the tap 36 in the bottom member 22 of the mounting plate, and the mounting screw 38 is driven through it into the tap 36. At each end of the slot 46, a transverse projection 48 of a cross section rounded arcuately to complement the shape of notches 40 extends from the upper mounting plate member 20, and its free ends project beyond the lateral boundaries of the upper mounting plate member 20 which overall is also configured as an elongated, barlike mounting section 50.

In its front end area, i.e., the one pointing out of the cabinet interior, the upper mounting plate member 20 has a central tap 52 in which a threaded spindle 54 is driven at whose bottom end, i.e., the end adjacent the bottom mounting plate member 22, on the end of a neck 56 of reduced diameter, a holding head 58 is provided whose diameter is again larger. The diameter of the neck 56 approximately corresponds to the width of slot 42, and also of the transverse slot section 44, so that the neck 56 can be inserted into the slot section 44 through the open longitudinal slot 42, and then is secure against lifting away by the holding head 58. When the neck 56 is in the correct position in the slot section 44, the projections 48 become engaged in the notches 40, so that, when the screw 38 is tightened, the upper mounting plate member 20 is held securely on all sides against displacement on the bottom mounting plate member 22. When the screw 38 is loosened, however, it becomes possible to shift the upper mounting plate member 20 within the length of the slot section 44 or of slot 46, so that the upper member 20 and thus the supporting arm 10 fastened thereon can be adjusted in height relative to the bottom mounting plate member 22.

From the lateral boundary surfaces of the mounting section 50 of the upper mounting plate member 20, projections 60 project laterally in the front end area, and are rounded arcuately, again, at their front boundary surface pointing out of the cabinet interior. At the cabinet-interior end, the upper mounting plate member, however, is provided with a recess 62 open at the top and rear end, which is narrowed at the top by projections 64 extending inwardly toward one another. At the bottom the projections 64 thus form undercuts 66, while the opposite upper surfaces are configured as ramps 68 sloping downwardly. The recess 62 narrowed at the top by the projections 64 forms the mounting plate end portion of a catch mechanism which cooperates with catch tongues on the supporting arm 10, to be described below, such that the supporting arm can be snapped simply and quickly onto the mounting plate and removed therefrom.

For this purpose the supporting arm 10 is provided, in the areas of its flanges 14 associated with the projections 60 of the upper mounting plate member, with indentations 70 which are accessible from the bottom margins and permit the introduction of the projections 60. These indentations 70 are shaped to match the arcuately rounded front surfaces of the projections 60, so that it is possible to push the supporting arm with its rearward end raised in the manner represented in FIG. 1 onto the mounting section 50 of the upper mounting plate member, until the projections 60 are situated in the indentations 70. The rear end, i.e., the cabinet-interior end, of the supporting arm 10 can then be rocked downwardly in order to lock it to the upper mounting plate member 20.

The part of the catch mechanism provided on the supporting arm is formed by two spring tongues 72 cut from the material of the flanges 14 of the supporting arm, each tongue being formed by a cut or slit 74. The strap-like sections of the flanges which form the tongues are thus integrally joined at the front end to the flanges 14, and they may have a reduced thickness in the area of transition to the flanges 14 in order to permit a resilient flexure of the tongues preferentially in this transitional area. After this transitional area a section 76 of each tongue runs outwardly at an angle toward the cabinet interior, and is followed by a section 78 bent back approximately parallel to the longitudinal central axis and forming a handle, from which in turn a tongue section 80 is bent inwardly toward the longitudinal central axis, from which at last a tongue section forming the actual catch section 82 of the resilient tongue 72 is bent, such that these final tongue or catch sections 82 enter through a window-like opening 84, through an end wall 86 terminating the supporting arm 10 at the cabinet-interior end, into the interior of the supporting arm. The window-like opening 84 supports the catch sections 82 against deformation at right angles to the supporting wall surface, but permits the tongues 72 to flex when the tongue sections 78 serving as handles are squeezed together.

It is now apparent that, when the rearward end of the supporting arm 10 is pressed down onto the upper mounting plate member 20 the inner ends of the catch sections 82 will encounter the ramp surfaces 68 and then, while the tongues 72 flex together, slide on the ramps 68 until their upper margins, upon reaching the correct catching position, pass over the narrow point formed between the projections 64 and spring apart behind the undercuts 66, the upper edge of the catch sections 82 then being locked against the associated undercut surface 66. The supporting arm then can no longer be lifted, unless first the catch sections 82 are forced inwardly by exerting pressure on the handle-forming tongue sections 78 sufficiently to free them from the undercuts 66. The supporting arm 10 can then be raised up again by exerting a pull away from the supporting arm by means of the fingers squeezing the tongue sections 78 together and then pulling it forward away from the mounting plate. The operation of the catch mechanism is thus explained.

In FIGS. 2 and 3 it can be seen that, in the web connecting the flanges 14 of the supporting arm, circular openings 88 and 90 are provided in the area which, when the supporting arm 10 is in the correct position on the mounting plate 12, is situated above the threaded spindle 54 and the screw 38, and through these openings a screwdriver can be applied to threaded spindle 54 and to the head of screw 38. The threaded spindle 54 can thus be rotated while the supporting arm 10 is in place, in which case then the upper mounting plate member 20 can be turned relative to the bottom member 22 to the effect of lowering or raising the upper mounting plate member from the bottom mounting plate member, according to the direction of rotation of the threaded spindle 54. The pivot of the mounting plate members is formed by the projections 48 of the upper member engaging in the openings 40 in the side walls 32 of the bottom member. In the event of an adjustment of the supporting arm by turning the threaded spindle 54, it is not necessary to loosen the screw 38, because the lug 34 in whose tap the screw is threaded changes the relative position of the upper member to the lower member of the mounting plate by resilient flexure.

The second embodiment of the hinge in accordance with the invention, shown in FIGS. 8 to 14, bears many resemblances to the embodiment just described as regards the configuration of the catch mechanism responsible for the easy and quick mounting and dismounting of the supporting arm on the mounting plate, so that, to avoid repetitions, it will suffice to describe the differences from the first embodiment, and in regard to the similarities it will be sufficient to refer to the above description, inasmuch as functionally equal parts of the two embodiments are given the same reference numbers preceded in the second embodiment by a numeral 1.

The supporting arm 110 is virtually identical to the supporting arm 10, except that the opening 90 provided in the web of the supporting arm for access to the screw 38 is eliminated because in the second embodiment a screw corresponding to screw 38 is not provided. With regard to the catch mechanism and the rotation of the upper mounting plate member relative to the lower member 122 by a threaded spindle 154 corresponding to threaded spindle 54, the upper mounting plate member 120 corresponds to the bottom member 20. The only difference is the manner in which the cabinet-interior end of the upper mounting plate member 120 is pivoted on the lower member 122. The openings 40 in the lateral walls 32 of the lower mounting plate member and the projections 48 of the upper member 20 are replaced by aligned pivot holes 140 and 148 in lugs 133 in the lower rear end area of the bottom mounting plate 122 which project upwardly from the lateral walls 132 of the bottom mounting plate member 122 and accommodate between them the upper mounting plate member 120, while a pivot pin 138 (FIG. 8) passing through the pivot holes 140, 148, replaces the screw 38. Since in this embodiment there is no provision for height adjustment by a transverse displacement of the upper mounting plate member on the lower member, no slotted section corresponding to slotted section 44 is provided in the second embodiment, while the longitudinal slot 144 corresponding to longitudinal slot 44 for holding the neck portion 156 of the threaded spindle 154 is, of course, provided also in the second embodiment. It is to be noted, however, that the second embodiment can be altered so that the function of "height adjustment" would be provided by mounting the upper mounting plate member 120 so as to be transversely displaceable and fixed at selected points on the bottom mounting plate member 122. All that is needed for this purpose would be, for example, to create between the lugs 133 and the section of the upper mounting plate member 120 held between them an appropriate amount of clearance so that the rear end of the upper mounting plate member will be mounted on the pivot pin not only for pivoting but also for lateral displacement. Furthermore, the transversely running slot section corresponding to slot section 44 would then have to be provided in the cabinet-exterior end of the bottom mounting plate member 122. Finally, to fix the relative position of the upper mounting plate member 120 on the bottom member 122, a set screw would have to be provided, which can be threaded through a tap in the upper member with its bottom end against the related surface of the bottom mounting plate member.

I claim:

1. A hinge for hanging a door on a carcase of a piece of furniture, said hinge comprising a door-related hinge part adapted to be fastened to the door, a mounting plate, a carcase-related hinge part adapted to be placed removeably on said mounting plate, adapted to be coupled to the door-related part by a linking mechanism, and configured as a supporting arm having an inverted U-shaped cross section straddling the mounting plate, said mounting plate being composed of two mounting plate members which are separable from one another and adjustable relative to one another, one of said mounting plate members being a bottom part adapted to be affixed to a supporting wall of the carcase, and the other being an upper part more remote from the wall than said bottom part, a catch mechanism releasably joining the upper part tot he supporting arm, in a cabinet-exterior end area of the upper mounting plate member nearer the door, said supporting arm partially straddling the upper mounting plate member at least at a cabinet-interior end area thereof remote from the door, said catch mechanism comprising two tongues on said supporting arm, respectively resiliently flexible parallel to the supporting wall, each tongue having a catch section, each catch section being held by form locking by an associated catch recess in the upper mounting plate member in a connecting position of the arm and upper mounting plate member, the catch sections and catch recesses being disengageable by flexing the tongues against one another parallel to the supporting wall, each tongue having a handle for exerting a pressure against one another parallel to the supporting wall.

2. A hinge in accordance with claim 1, wherein the resilient tongues are integral, strap-like sections cut from the material of the lateral flanges of the supporting arm.

3. A hinge in accordance with claim 2, wherein the resilient tongues are formed from the lateral flanges of the supporting arm by cuts starting from the cabinet-interior end thereof.

4. A hinge in accordance with claim 1, wherein the catch recesses provided in the upper mounting plate member have introduction openings opening on an upper side thereof facing the supporting arm for the catch sections provided on the resilient tongues, at least one of each said introduction openings and catch sections being provided with at least one ramp surface which upon insertion forces the associated catch section resiliently in a releasing direction, and being provided with an undercut into which, as insertion continues, the catch sections resiliently return when the supporting arm and the upper mounting plate member reach the connecting position.

5. A hinge in accordance with claim 1, wherein each tongue is a resilient tongue divided into a plurality of sections in an angular relationship to one another: a first section bent outwardly at an angle in the direction of the cabinet-interior end of the supporting arm, a second adjacent tongue section bent back to a position approximately parallel to a longitudinal central axis of the supporting arm, a third,adjacent tongue section bent approximately at right angles to the longitudinal central axis, and a fourth, terminal tongue section, forming the actual catch section, bent back to a position approximately parallel to the longitudinal central axis.

6. A hinge in accordance with claim 5, wherein the catch section is bent back toward the cabinet-exterior end of the supporting arm from the third tongue section.

7. A hinge in accordance with claim 6, wherein the resilient tongues in the vicinity of the catch section extend through a window-like opening in a wall of the supporting arm that overreaches a cabinet-interior end wall of the upper mounting plate member, the opening having a clear height, measured at right angles to the supporting wall which is approximately equal to or only slightly greater than the height of the tongue section passing through the opening, the opening also having a clear width, measured in the direction of actuation of the tongue upon release from said upper mounting plate member, which is of a size corresponding to the tongue movement necessary for release thereof.

8. A hinge in accordance with claim 1, wherein the upper mounting plate member is mounted at its rear, cabinetinterior end portion for pivoting on the bottom mounting plate member about a pivot axis parallel to the supporting wall and at right angles to the length of the supporting arm, in a front end area of the upper mounting plate member a threaded spindle being screwed into a tap running at right angles to the supporting wall, said spindle having at a supporting wall end a holding head connected to the threaded spindle by a neck of reduced diameter, the neck being held in a longitudinally running slot in the lower mounting plate member, the slot having a mouth open at the cabinet-exterior end.

9. A hinge in accordance with claim 8, wherein the lower mounting plate member has wing-like projections extending respectively from opposite longitudinal sides of the lower mounting plate member, in each of the projections there being a mounting opening.

10. A hinge in accordance with claim 9, wherein the mounting openings in the wing-like projections are in the form of elongated holes running parallel to the length of the supporting arm.

11. A hinge in accordance with claim 8, wherein the pivot axis permitting relative rotation of the upper toward the lower mounting plate member is formed by a projection extending from one mounting plate member to the other mounting plate member and running transversely of the length of the supporting arm, and being journaled in at least one notch of the same orientation in the other mounting plate member, and a passage intersecting the pivot axis at right angles and passing through the upper mounting plate member, a threaded shaft of a mounting screw being threaded through said passage into a tap in the lower mounting plate member.

12. A hinge in accordance with claim 11, wherein the lower mounting plate member is a stamped sheet metal piece, the tap being provided in a resiliently flexible lug punched from the lower mounting plate member.

13. A hinge in accordance with claim 11, wherein the projection extends from two opposite sides of the associated mounting plate member, the passage being in the form of an elongated hole running transversely of the supporting arm length, the longitudinal slot in the lower mounting plate member merging, in the area through which the neck of the threaded spindle passes, with an elongated slot section also running transversely of the length of the supporting arm, and having a free width approximately equal to or only slightly greater than the diameter of the neck.

14. A hinge in accordance with claim 8, wherein one of the two mounting plate members straddles the other in the area of the pivot axis permitting their relative rotation, aligned pivot bores being provided in the overlapping areas of the mounting plate members through which a pivot pin passes.

* * * * *